United States Patent [19]

McBain

[11] Patent Number: 4,905,603

[45] Date of Patent: Mar. 6, 1990

[54] EXPLOSIVELY OPERATED INDUSTRIAL TOOL

[75] Inventor: Reid McBain, Agincourt, Canada

[73] Assignee: AMP Incorporated, Harrisburg, Pa.

[21] Appl. No.: 375,752

[22] Filed: Jul. 5, 1989

[51] Int. Cl.[4] ..... C06D 5/00

[52] U.S. Cl. ..... 102/530

[58] Field of Search ..... 102/530, 531; 227/9, 227/10

[56] References Cited

U.S. PATENT DOCUMENTS

| | | | |
|---|---|---|---|
| 2,061,641 | 6/1934 | Tinkham | 220/3 |
| 3,212,534 | 8/1962 | Broske | 140/113 |
| 3,296,792 | 1/1967 | Hedberg et al. | 227/9 |
| 3,343,294 | 9/1967 | Wahl | 227/9 |
| 4,600,123 | 7/1986 | Galbraith | 222/3 |

*Primary Examiner*—Charles T. Jordan
*Assistant Examiner*—Rochelle Lieberman
*Attorney, Agent, or Firm*—Allan B. Osborne

[57] ABSTRACT

An improved explosively operated industrial tool and improved cartridge therefore. More particularly the tool includes a simple breach cap with a hole therethrough and the cartridge includes two discs bonded together with each disc being of a material having a different expansion parameter relative to the other. A plug positioned in a hole in the base of the cartridge is gripped by the disc subassembly.

3 Claims, 4 Drawing Sheets

EXPLOSIVELY OPERATED INDUSTRIAL TOOL

FIELD OF THE INVENTION

This invention relates to explosively operated tools. More particularly, it relates to cartridges which are adapted for use in providing the power means for explosively operated industrial tools and to a tool for use therewith.

BACKGROUND OF THE INVENTION

It is known from U.S. Pat. No. 3,212,534 to provide an industrial tool in which a ram is driven forward to do work by gases generated by an exploding cartridge. The tool includes a two piece breech cap having a piercer pin which is driven into the base of the cartridge inserted into the breech. Upon striking the rear of the tool with a hammer, the ram moves back, detonating the primer located near the open end of the cartridge and thereby igniting the powder located between the primer and base. The expounding gases from the burning powder pushes the ram forward. After firing, the breech cap is loosened to pull back the piercer pin for enough to allow the gases remaining in the cartridge to escape through the base and through ports in the breech cap.

The above described method for venting residue gases is acceptable but it does require a position step by the worker. Should he forget to take this step and instead lays the tool down, possible minor harm could occur to another, unsuspecting worker who picks the tool up. Accordingly, it is now proposed to provide an improved tool and cartridge wherein the venting of residue gases occurs automatically immediately after firing and after the work as been acheived.

SUMMARY OF THE INVENTION

According to the invention, and improved explosively operated industrial tool and improved cartridge for use therein is disclosed herein. The improved tool has a simple, one piece breech cap for covering the chamber and has a hole therethrough which communicates with the chamber. The cartridge includes a bimetallic disc subassembly in the base of a powder chamber and which grips a plug extending through the base. Upon being heated by the burning gases from the ignited powder, the bi-metallic disc bows inwardly, pulling the plug within to open a hole in the base through which residual gases can escape.

DESCRIPTION OF THE INVENTION

Figure 1:
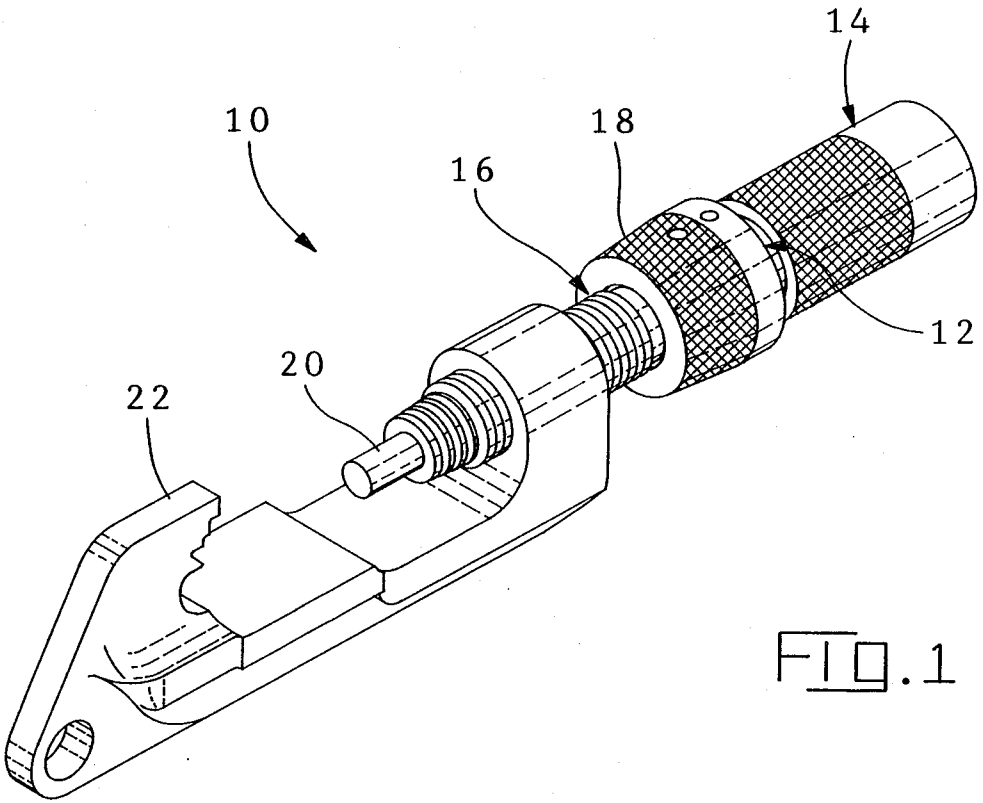
FIG. 1 is a perspective view of the improved tool for use with the improved cartridge.
Figure 2:
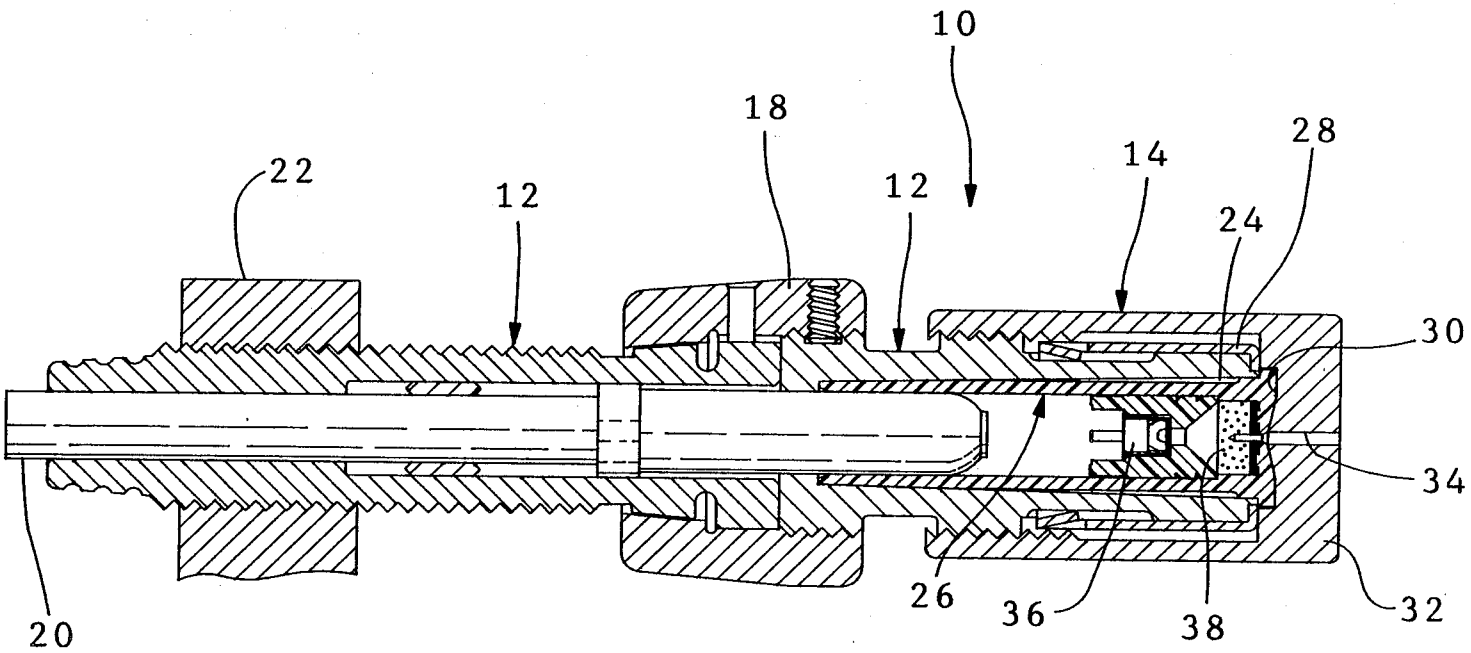
FIG. 2 is a sectional view of the tool with a cartridge therein.

Tool 10 shown in FIGS. 1 and 2 includes breech 12, breech cap 14 which is threadedly mounted on one end of breech 12, barrel 16 is attached to another end of breech 12 by coupling 18 and ram 20 slidingly mounted in breech 12 and barrel 16. Platform 22 for supporting a work piece (not shown) is threadedly attached to barrel 16.

As shown in FIG. 2, breech 12 is provided with chamber 24 which receives cartridge 26. Surrounding one end of breech 12 is cartridge ejector 28.

Breech cap 14 is provided with an annular recess 30 on the inside surface of base 32 and hole 34 which extends through base 32 from recess 30.

In operation, breech cap 14 is replaced after a cartridge 26 is placed in chamber 24 and tool 10 is struck on base 32 by a hammer. The force of the blow causes ram 20 to move rearwardly to strike and detonate primer 36. The exploding primer ignites powder 38 which produces the gases to drive ram 20 forward.

Figure 3:
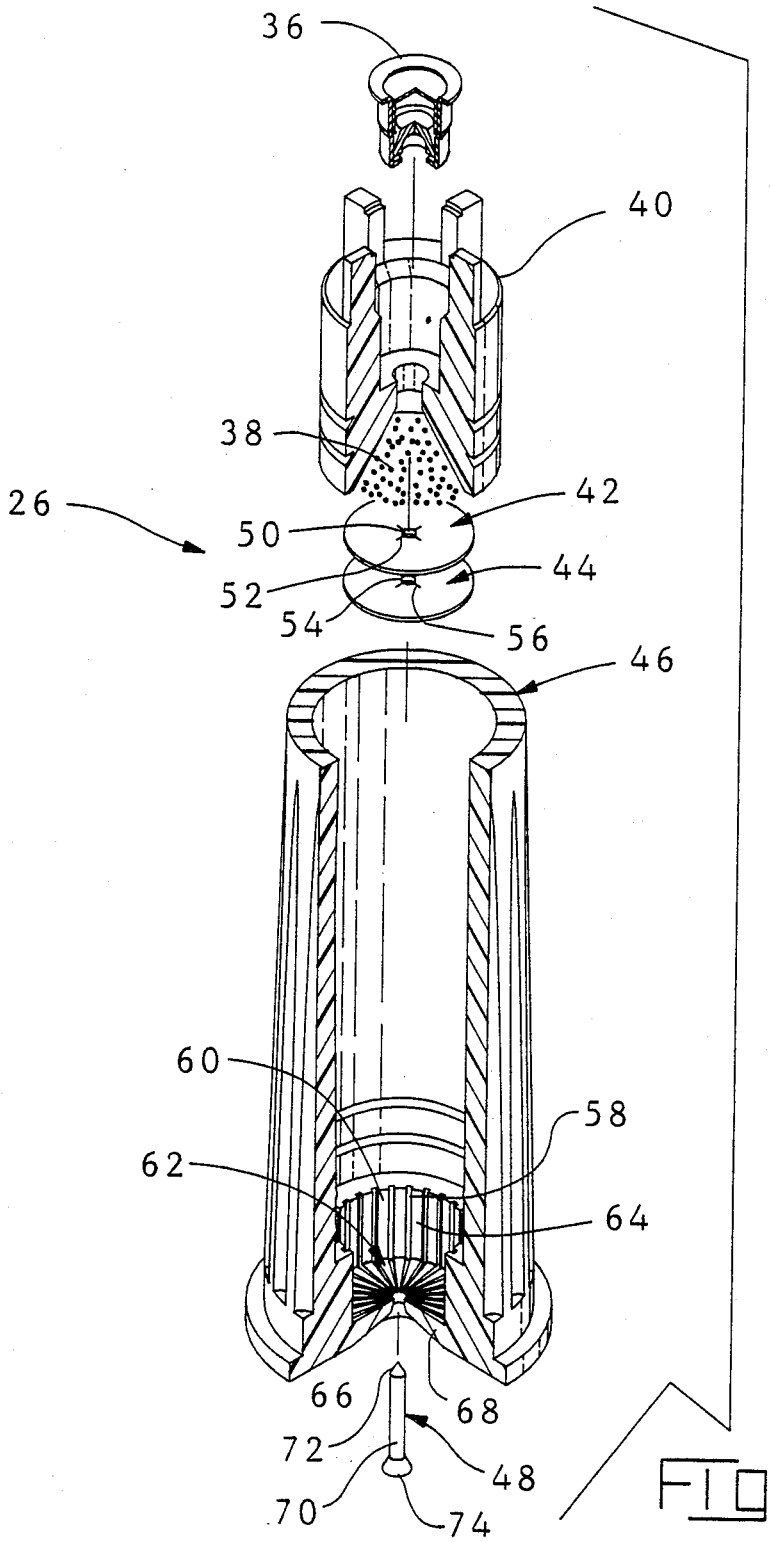
FIG. 3 is a cut-away, exploded view of the cartridge.

As shown in FIG. 3, the components of cartridge 26 include, from top to bottom, primer 36, gas check 40 in which primer 36 is seated, powder 38, first disc 42, second disc 44, shell 46 and plug pin 48. Primer 36, gas check 40 and powder 38 are well known in the art and need no detailed description. First disc 42 is preferably made from zinc and has a thickness of about 0.010 inches (0.254 mm). Centrally located hole 50 extends through disc 42 and four spaced apart slits 52 extend outwardly therefrom. second disc 44 is preferably made from nickel and has the same thickness as disc 42. Likewise, a hole 54 and slits 56 are provided in second disc 44.

Shells such as shell 46 are generally well known in the art. Shell 46 has been modified by adding a plurality of very small grooves 58 along the sides 60 and floor 62 cf powder chamber 64. Hole 66 through base 68 is tapered with the divergence being outwardly.

Plug pin 48 includes shaft 70 with a pointed tip 72 at one end and a conically or tapered head 74 at the other end.

Gas check 40 and shell 46 are preferably made from a plastics material such as polyethylene. Powder 38 is granular with the grain size being larger than grooves 58 in powder chamber 64. Discs 42 and 44 are bonded together using a suitable flexible adhesive to form disc subassembly 78. Plug pin 48 is made from a metal such as steel.

Figure 4:
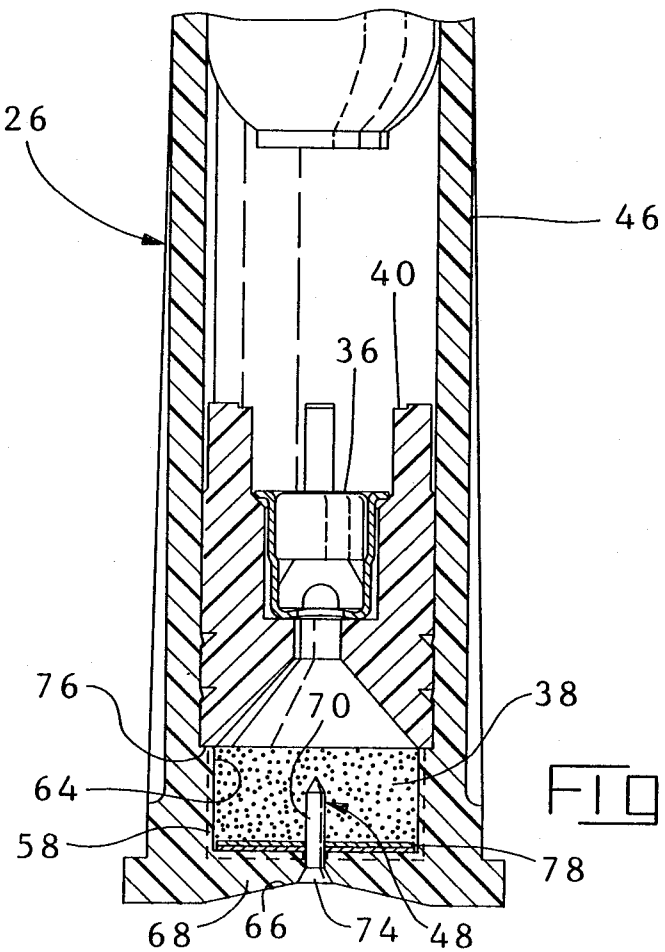
FIG. 4 is a sectional view of the assembled cartridge prior to being ignited.

FIG. 4 shows an assembled cartridge 26. Plug pin 48 is positioned in base 68 with the tapered head 74 conformably received in tapered hole 66 and shaft 70 extending into powder chamber 64. Further, the bonded disc subassembly 76 lies on floor 62 with powder 38 thereover and pin 48 passing very tightly through respective holes 50, 54. As in the prior art cartridges, gas check 40 and primer 36 contained therein are positioned over powder 38, resting on annular ledge 76.

Figure 5:
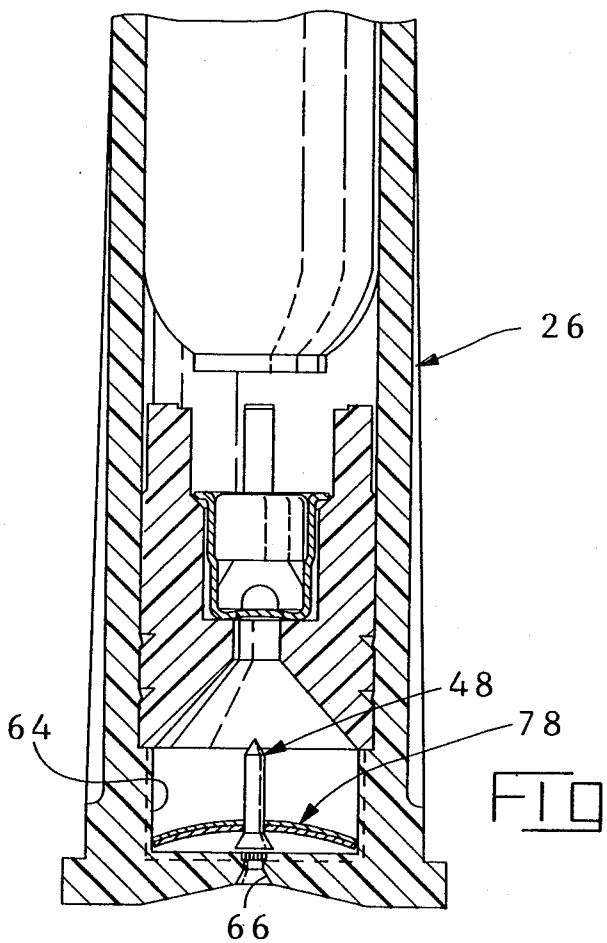
FIG. 5 is a sectional view of the cartridge after being ignited.

The automatic venting of residue gases from cartridge 26 occurs in the following manner. During ignition, the thin base 68 of shell 46 is protected by subassembly 78. After ignition, the hot gases flow beneath bonded disc subassembly 78 through grooves 58 and pressure equalizes on both sides of subassembly 78. As the zinc 42 expands more rapidly than nickel disc 44, subassembly 78 bows inwardly as shown in FIG. 5. Because plug pin 48 is tightly held in subassembly 78, it is pulled in causing head 74 thereon to be pulled in causing head 74 thereon to be pulled through hole 66. Hole 66 is now open to powder chamber 64 and the residual gases will escape therethrough and out through hole 34 in breech cap 14.

As can be discussed, an improved explosively operated industrial and cartridge tool has been disclosed. A single piece breech cap having a hole through the base replaces a complex two piece breech cap. The improved cartridge contains a bi-metallic disc subassembly in the base which, when heated by gases from the burning powder, bows inwardly, pulling a plug pin secured thereto through the cartridge base to provide an outlet for gases remaining in the cartridge. The gases escape the tool through the hole in the breech cap. Because no permanent tool parts come in direct contact with the burning gases, tool life is substantially extended.

I claim:

1. An improved cartridge for use in an explosively operated industrial tool of the type having a breech cap fitted over a chamber and the breech cap includes a hole therethrough in communication with the chamber, said cartridge comprising:

an elongated shell open at one end and having a base with a hole therethrough at another end;

a gas check and primer positioned in said shell between the open end and said base;

explosive powder contained in a powder chamber between said gas check and said base and in communication with said hole therein;

plug means in said hole and extending into said chamber; and a subassembly positioned in said chamber adjacent said base and gripping said plug means, said subassembly comprising a pair of discs bonded together with each disc being of a material having a different expansion parameter relative to the other and with the disc having the lowest expansion parameter being adjacent said base so that upon the powder being ignited, the subassembly will bow with the concave surface facing said base so that the plug means are pulled through said hole in said base.

2. The cartridge according to claim 1 wherein said plug means includes a head positioned in said hole and a shaft gripped by said subassembly.

3. The cartridge according to claim 1 wherein one disc is zinc and the other disc is nickel.

* * * * *